United States Patent [19]

Leary

[11] 4,111,387

[45] Sep. 5, 1978

[54] KITE-CONTROLLER

[76] Inventor: John Joseph Leary, 7 High St., Natick, Mass. 01760

[21] Appl. No.: 739,615

[22] Filed: Nov. 8, 1976

[51] Int. Cl.[2] ..... A63H 27/08

[52] U.S. Cl. ..... 244/155 A; 242/96; 242/99

[58] Field of Search ..... 244/153–155; 242/96, 99, 84.1 J, 84.2 J, 84.53, 117, 129.6, 129.5, 141; 46/77

[56] References Cited

U.S. PATENT DOCUMENTS

| | | | |
|---|---|---|---|
| 151,612 | 6/1874 | Norton | 242/96 |
| 485,275 | 11/1892 | Hanson | 242/96 |
| 606,666 | 7/1898 | Hubner | 242/96 |
| 2,685,283 | 8/1954 | Bucklin | 242/96 |
| 2,923,490 | 2/1960 | Smith | 244/155 A |
| 3,011,734 | 12/1961 | Wilkinson | 242/96 |
| 3,026,052 | 3/1962 | Wade | 242/96 X |
| 3,830,443 | 8/1974 | Quenot | 242/96 |

FOREIGN PATENT DOCUMENTS

| | | | |
|---|---|---|---|
| 99,504 | 6/1923 | Switzerland | 242/96 |
| 839,209 | 6/1960 | United Kingdom | 242/96 |

*Primary Examiner*—Galen L. Barefoot
*Attorney, Agent, or Firm*—Joseph H. Killion

[57] ABSTRACT

An improved method and apparatus for controlling a kite is disclosed which comprises a handle having a substantially eccentric U-shaped extension ending in a pair of outwardly extending legs. A spool rotatable forwardly and reversibly is mounted between the legs to hold the kite-line. A crank is fixedly mounted to the spool at the outermost end of the substantially eccentric U-shaped extension of the handle to rotate the spool. Braking are fixedly mounted to the other end of the spool.

3 Claims, 2 Drawing Figures

KITE-CONTROLLER

BACKGROUND OF THE INVENTION

Kite-flying is a pleasant and popular avocation, but it has its difficulties in control of the kite and kite-line.

A number of spools have been promoted for kite-flying. However, some are more suitable for fishing, and some are intended for universal application. The present spools have significant disadvantages.

For example, U.S. Pat. No. 2,537,613 discloses a reel device particularly suitable for fishing. This particular device is intented for one-handed casting. At the very least it is difficult to one-hand cast a kite. Also there is no mechanical provision for play on the line as the braking means is an off/on arrangement which can snap a kite-line. Finally, the line is retained on a frustro-conical reel, a difficult configuration to maintain with 200–250 feet of kite-line.

U.S. Pat. No. 2,587,432 discloses a reel device particularly intended for kite-flying. A line-guide which is finger-controlled interferes with the rapid play out or taking in of line. This device has no braking mechanism, just a drag effect brought into play by the operator's axial movement of the line-guide. Also, the handle is clumsy, uncomfortable to hold and can pinch the kite-flyer's fingers between the central shaft and the spring mechanism for the line-guide.

U.S. Pat. No. 2,600,049 discloses a kite spool primarily intended for one-handed usage. The braking mechanism requires careful coordination of the reel and brake as a quick release of the brake can break the kite-line. Also, it is necessary to allow a fairly large contact area for the brake shoes on the outer edges of the spool itself. This permits the possibility of a hopeless snarl when the kite-line is being reeled in. Also the device has a large number of parts and is extremely complicated and expensive to manufacture.

There are a number of other devices which are uncomfortable to use, complicated mechanically, expensive and difficult to manufacture.

There is then a need for a kite-controller which is comfortable to operate with two hands, non-snarling, readily rotated for play of line, readily braked, has the minimum number of parts and is relatively inexpensive to make.

SUMMARY OF INVENTION

My invention relates to an improved kite-controlling device and an improved method for kite-flying.

I have discovered an improved kite-controller device which comprises handle means having a substantially eccentric U-shaped extension ending in a pair of outwardly extending legs. A spool means rotatable forwardly and reversibly is mounted between said legs to hold the kite-line. A crank means is fixedly mounted to said spool means at the outermost end of said substantially eccentric U-shaped extension of said handle means to rotate said spool means. Braking means are fixedly mounted to the other end of said spool.

My method for flying a kite on a kite-line comprises playing out the kite-line from a spool retained by a handle with an eccentric U-shaped extension thereon by allowing the spool to freely rotate. The play out of the kite-line is braked by depressing with an index finger an eccentric brake located at the innermost side of said handle from a first position distant said handle to a second position adjacent said handle. The kite-controller is then grasped with one hand on the U-shaped extension and the other on the handle to guide the kite while in flight. The line is taken in by rotating the crank in the opposite direction.

Preferably but optionally my kite-controller is molded with finger-grips both on the handle and on the curve of the U-shaped extension. An optional feature of my invention is the incorporation of five finger grooves on the grip to allow the user to lower the hand one space when the braking means is rotating to avoid contact of the braking means with his hand.

The handle means preferably has a substantially U-shaped extension in an eccentric position to make two-handled use and brake control more comfortable. A symmetrical U-shaped extension of the handle is contemplated also for the invention.

The handle means may be made of a number of materials including metal, wood or plastic, particularly a foamed thermoplastic and more patricularly foamed polyethylene or polypropylene, which makes the kite-controller light without sacrificing strength.

The spool means will be described in detail in the preferred embodiment. Preferably, and optionally, a line-receiving groove is employed to which the kite-line is fastened together with an uneven area provided to mitigate slippage of the line. It is preferred, but not necessary, that the spool means extend through the apertures and that the spool means be manufactured from material which displays good anti-frictional characteristics with the walls of said apertures. It is preferred, but optional, that the spool means be molded from a plastic material, particularly a low-coeffluent-of friction thermoplastic material such as, for example, polypropylene or molybdynum filled nylon to enhance free rotation of the spool means when the kite line is being played out or taken in at a rapid rate.

The crank means is preferentially located on the outermost end of the handle, and is described in the preferred embodiment where a perpendicularly displaced crank means is used. However, it is recognized that many other configurations and cranks may be employed for the same purpose.

It is preferred that the braking means be located at the innermost surface of the U-shape where it can be controlled by the index finger of the right hand by a right-handed person, or if desired, the index finger of the left hand. In the preferred embodiment a perpendicularly displaced braking means is used. However, it is recognized that other configurations such as a button-type brake may be utilized.

It is preferred to make the spool means, crank means and braking means as a single molded unit from molded material, particularly plastic material, and more particularly a low-coefficent-of friction thermoplastic material such as polypropylene or molybdenum-filled nylon.

My invention provides numerous advantages over those devices found in the prior art. It is an advantage of my invention that it can be made in as few as three pieces and from light, yet strong and durable plastic thermoplastic materials.

It is an advantage of my invention that it is extremely comfortable to use with two hands and that the braking means is readily accessible to the kite-flyer to either put drag on the kite-line or completely stop the kite-line.

It is an advantage of my invention that it is simple mechanically and does not require metal-close tolerances nor expensive and mechanically fraught gears and rachets.

Further advantages of my invention are that it is light, yet comfortable, secure and stable while in use, that it is strong and durable, lightning-proof, anti-rust, simple to manufacture, efficient and economical.

DETAILED DESCRIPTION OF THE DRAWINGS

Figure 1:
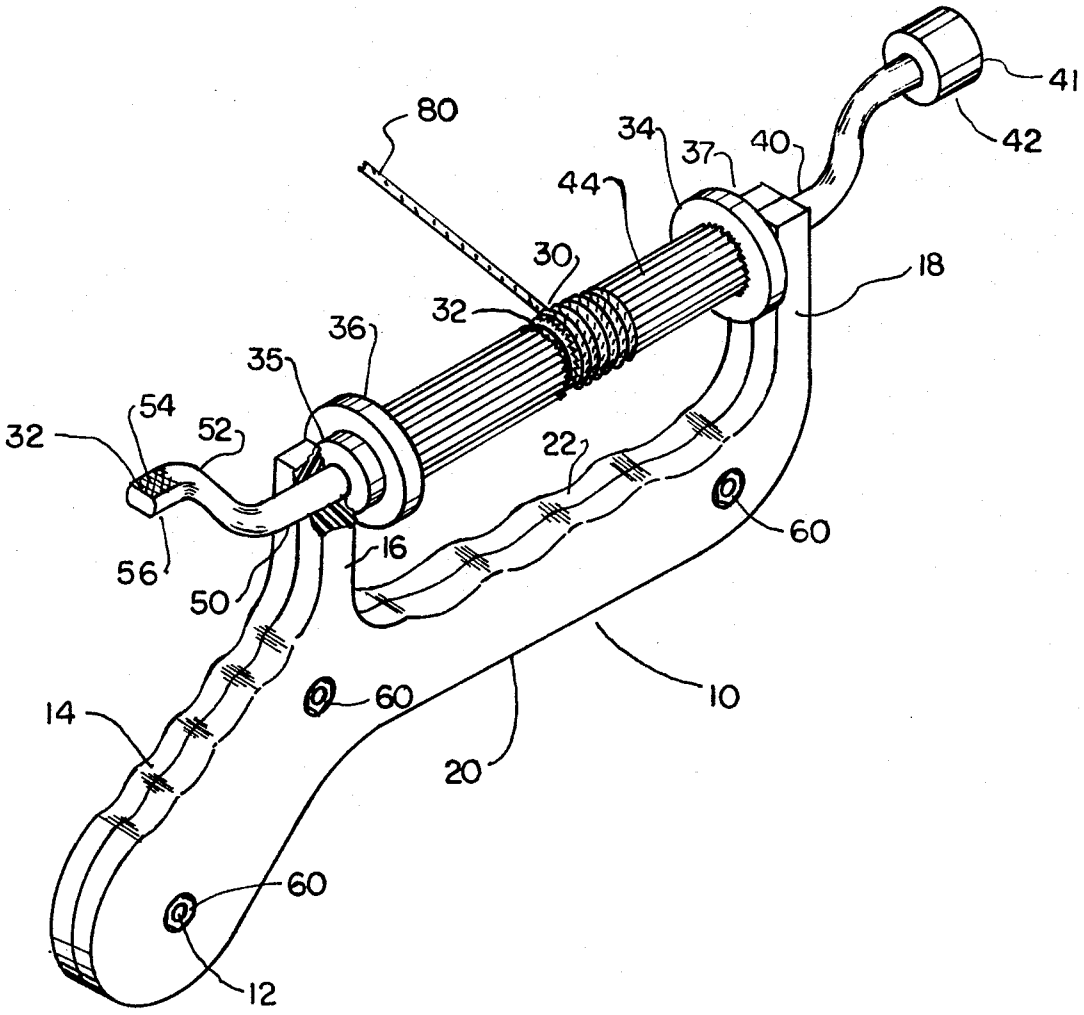
FIG. 1 is a perspective view of the kite-controller according to the invention.
Figure 2:
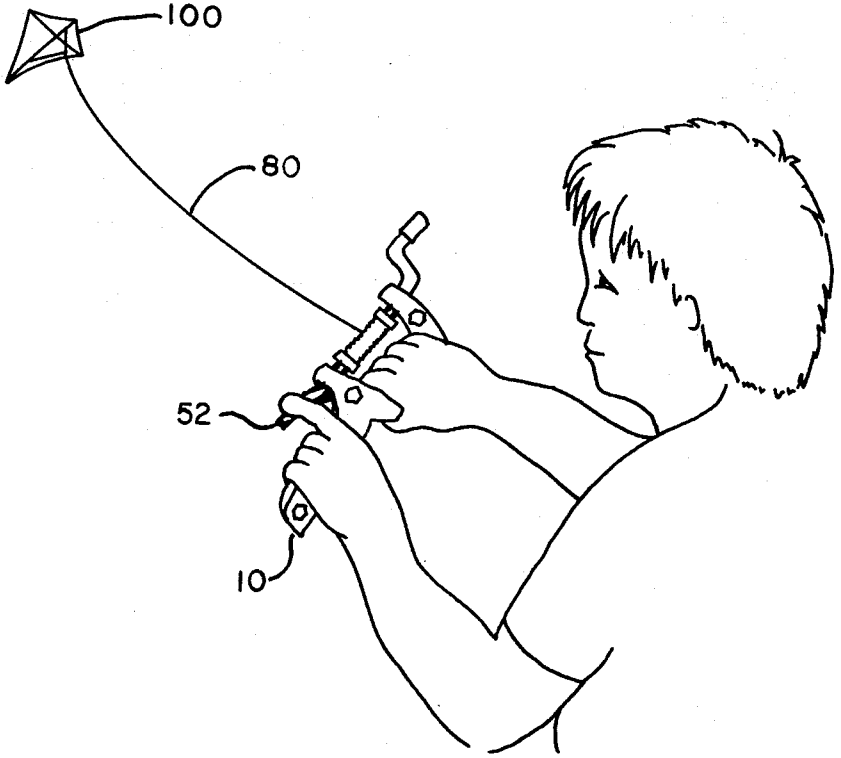
FIG. 2 is an enlarged view in elevation of the kite-controller in FIG. 1 showing the crank means and braking means in one position.

Referring now in particular to the accompanying drawings my kite-controller is generally indicated in FIG. 1 and FIG. 2 at 10 and includes a handle 12 with five finger grips 14. The handle includes eccentric U-shaped extension 20 with finger grips 22 having outwardly extending legs 16, 18, defining longitudinal apertures 38, 39. Spool 30 is rotatably mounted there between to receive and disperse kite-line 80 connected to kite 100. The spool includes a line-receiving groove 30 and anti-slip grooves 44 and has a pair of annular flanges 34, 36, to retain the line on the cylindrical intermediate portion. Spacers 35, 37 minimize contact between the annular flanges and the legs. The spool has extensions 40, 50, passing through the apertures and connected at the outermost end to a perpendicularly displaced crank 40 having cap 42 and at the innermost end to eccentric friction finger brake 52 having anti-slip grooves 54 and bent to form end 56 perpendicular to the handle. When in use by a right-handed person, the index finger of the right hand is placed on the end 56 displacing the end of the brake downwardly against the handle to be retained by the upper joint of the index finger.

Screws 60 join the handle sections 12, 14 together.

Typically in use the crank is released and the line pays out as the kite ascends. The left hand of the user grips the grooves on the U-shaped extension. If drag is desired the index finger contacts the brake intermittantly to slow the kite down. When the kite reaches the desired length the brake is securely retained by the index finger. Both hands then rest comfortably on the kite-controller and the kite can be played as desired. When it is desired to reel in the kite, the brake is released and the crank rotated, pulling in the kite line around the spool.

While a preferred embodiment of my invention has been set forth and described herein, it is to be understood that various modifications and changes may be made therein. For example, the crank, spool and brake my be separate members, the apertures may have a low-coeffluent-of friction molding retained therein to increase free rotation, and the various members may be made of various different materials without departing from the spirit and scope of my invention.

What I claim is:

1. A kite-controller comprising:

(a) a handle means having a substantially eccentric U-shaped extension ending in a pair of outwardly extending legs;

(b) a spool means mounted between said legs and rotatable forwardly and reversibly;

(c) crank means fixedly mounted to said spool means at the outermost end of said substantially eccentric U-shaped extension of said handle means, to rotate said spool means;

(d) braking means having a substantially cylindrical member fixedly mounted to said spool means at one end and extending substantially perpendicular to said spool means for a portion thereof and then extending substantially parallel to said spool means to the end thereof, displacable from a first position distant said handle means to a second position adjacent said handle means and back thereto to brake said spool means, and having an elliptical end portion thereon defining a series of gripping grooves on the top surface thereof.

2. A kite-controller comprising:

(a) handle means having a substantially eccentric U-shaped extension ending in a pair of outwardly extending legs each of which defines an aligned longditudinal aperture there through and having a plurality of gripping grooves along the outermost side of the handle and the outermost side of said U-shaped extension to retain the user's fingers;

(b) spool means rotatably forwardly and reversibly mounted between said legs having a cylindrical intermediate portion between a pair of annular flanges which retain the kite-line and a pair of annular spacers smaller in diameter than said annular flanges positioned on said spool between said annular flanges and said legs to decrease frictional contact between said flanges and said legs and a line-receiving groove located on said cylindrical intermediate portion of the kite-line and a multiplicity of anti-slip grooves channelled into said spool means to minimize slippage of the first layers of kite-line;

(c) crank means having a substantially cylindrical member fixedly mounted at one end to said spool means and extending substantially perpendicularly from said spool means for a portion thereof and then extending substantially parallel to said spool means and defining a cap at the end thereof to fit the user's hand as said spool means is rotated;

(d) braking means having a substantially cylindrical member fixedly mounted to said spool means at one end and extending substantially perpendicular to said spool means for a portion thereof and then extending substantially parallel to said spool means to the end thereof, displacable from a first position distant said handle means to a second position adjacent said handle means and back thereto to brake said spool means and braking means is elliptical and defines a series of gripping grooves on the top surface thereof.

3. A kite-controller as in claim 2 wherein said spool means, crank means and braking means are a unitary construction.

* * * * *